United States Patent [19]

Natori

[11] Patent Number: 5,052,464

[45] Date of Patent: Oct. 1, 1991

[54] METHOD OF CASTING A MEMBER HAVING AN IMPROVED SURFACE LAYER

[75] Inventor: Tatsuo Natori, Kashiwa, Japan

[73] Assignee: Hitachi, Ltd., Tokyo, Japan

[21] Appl. No.: 347,580

[22] Filed: May 5, 1989

[30] Foreign Application Priority Data

May 11, 1988 [JP] Japan ..... 63-114148

[51] Int. Cl.[5] ..... B22D 19/14; B22D 23/06

[52] U.S. Cl. ..... 164/80; 164/97

[58] Field of Search ..... 164/97, 98, 80

[56] References Cited

U.S. PATENT DOCUMENTS

| | | | |
|---|---|---|---|
| 4,708,104 | 11/1987 | Day et al. | 164/97 X |
| 4,715,422 | 12/1987 | Tommis et al. | 164/97 |
| 4,755,437 | 7/1988 | Sabatie et al. | 164/97 X |
| 4,828,008 | 5/1989 | White et al. | 164/97 X |
| 4,909,300 | 3/1990 | Horie | 164/97 X |

FOREIGN PATENT DOCUMENTS

| | | | |
|---|---|---|---|
| 58-215263 | 12/1983 | Japan | 164/97 |
| 60-21306 | 2/1985 | Japan | 164/97 |

OTHER PUBLICATIONS

Nippon Ceramics Kyokai Gijutsu Ronbun-Shi, vol. 96, No. 3, 1988, pp. 292-298.

*Primary Examiner*—J. Reed Batten, Jr.

*Attorney, Agent, or Firm*—Antonelli, Terry, Stout & Kraus

[57] ABSTRACT

A mixture of ceramic particles (such as SiC particles) with metallic powder (such as iron-base particles, e.g., stainless steel particles) is placed in a predetermined position of an internal wall of a mold and a molten metal (e.g., molten iron-base metal, particularly molten cast iron) is poured into the mold. In this manner a wear-resistant layer is formed in a necessary portion on a surface of the casting at the same time when casting is conducted.

4 Claims, 3 Drawing Sheets

FIG. 1
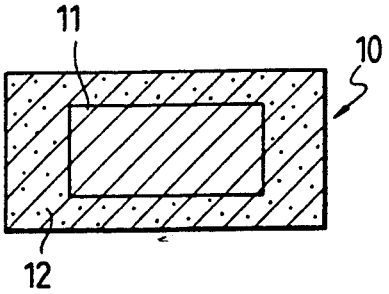
FIG. 2
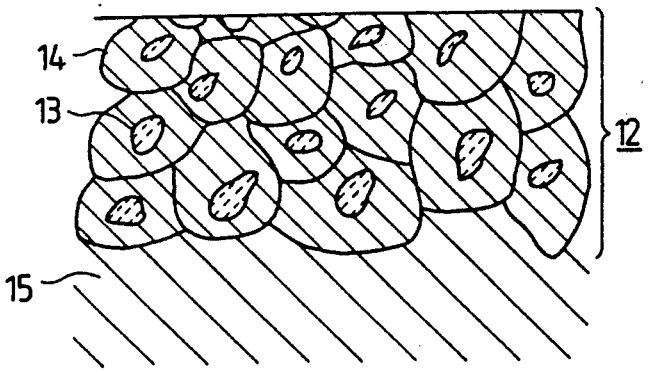
FIG. 3
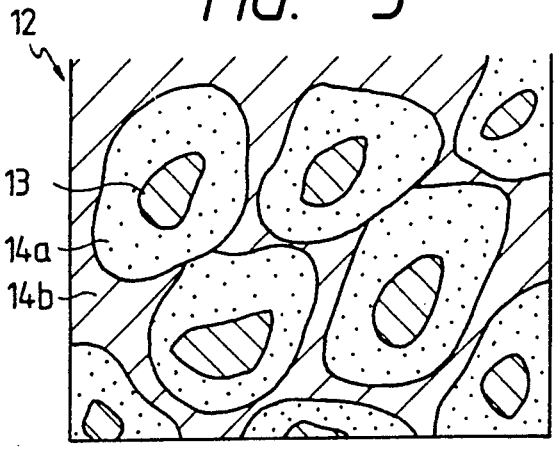
FIG. 4(a)
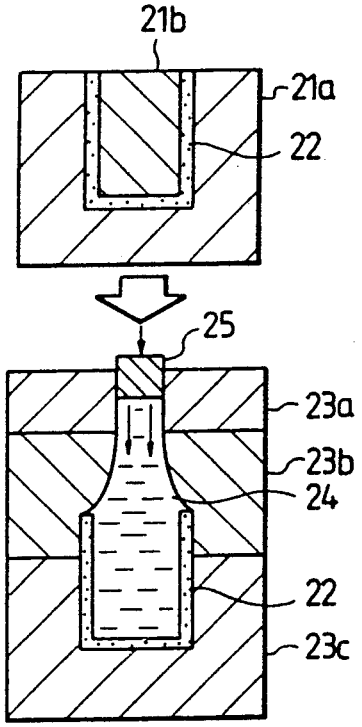
FIG. 4(b)
FIG. 4(c)
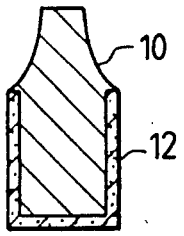

METHOD OF CASTING A MEMBER HAVING AN IMPROVED SURFACE LAYER

BACKGROUND OF THE INVENTION

The present invention relates to a member having an improved surface layer and a process for making the same. More particularly, the present invention is concerned with a member having an improved surface layer which can withstand a severe wearing environment, and a process for making the same.

Many industrial machinery and construction machinery members (e.g., the impeller and casing of a pump) are required to have wear resistance. The wear resistance has been improved in the art by the following methods depending upon the applications.

First Prior Art Method

In this method, an alloying element is added to make the material of the whole member wear-resistant. For example, high chromium cast iron and high manganese cast steel (Hadfield steel) are known as such a material. The latter aims at surface hardening through work hardening. In both cases, the hardness of the material forming the whole member is improved, which renders the member wear-resistant.

Second Prior Art Method

Examples of this method known in the art include one wherein the surface of a member is subjected to hard chromium plating, electroless plating following the dispersion of ceramic particles thereon, or spraying of ceramic. According to this method, a thin plating layer formed on the surface of the member contributes to an improvement in the wear resistance.

Third Prior Art Method

Examples of this additional method known in the art include one wherein the surface of a member is subjected to surface quenching through induction heating or plasma heating, or subjected to heat treatment, such as cementation or nitriding, to harden the surface of the material. In this method, the metal surface is hardened by taking advantage of the martensitic transformation of iron to improve the wear resistance.

The above-described prior art methods each can impart wear resistance to a member to some extent. However, members of a pump for transferring a fluid containing highly abrasive material, such as sediment, or construction machinery members used under similar severe abrasive conditions are required to have particularly high wear resistance and high toughness, which brings about the following problems.

Specifically, according to the first prior art method, not only the surface layer but also internal material is hardened, so that the material becomes fragile. Therefore, this material cannot be applied to machinery members etc. which require a combination of wear resistance with toughness.

In this respect, the second and third prior art methods bring about not problem because they pertain to only surface improvement so that the toughness of the matrix material is maintained intact.

However, according to the method wherein ceramic is sprayed, it is difficult to attain uniform thickness, which makes it necessary to further conduct machining after spraying when dimensional accuracy is required.

On the other hand, the plating method is excellent in the uniformity of the thickness. Further, with respect to the hardness of the coating per se, the coating formed by the electroless plating has an Hv value of 900 and the one formed by the hard chromium plating has an Hv value of 1300. Therefore, an improvement in the wear resistance can be attained over common steel having an Hv value of 200 to 300.

However, in this second prior art method, since the thickness of the improved surface layer is small (e.g., about 500 μm in the case of the spraying and 50 μm or less in the case of the plating), there occurs a problem that the coating is worn out in a short period of time under severe abrasive conditions. For example, when a mixture of water with sand was blasted at a high speed on a 20 μm-thick coating formed by plating, the coating was entirely abraded and peeled in about 0.5 min.

In the third prior art method wherein surface heat treatment is conducted, the heating often cause the shape and dimension of the product to be changed and cracks to occur. Therefore, in the case of a member of which a high accuracy is required, re-machining should be conducted. In particular, when the material is cast iron, this method is scarcely employed because the product is susceptible to cracking due to expansion of graphite.

As described above, the first to third prior art methods have a problem that they cannot provide a member having a combination of toughness, as a whole, with high wear resistance.

On the other hand, a proposal has been made on a method which comprises mixing alumina powder ($Al_2O_3$) with iron powder and sintering the mixture, thereby imparting toughness to a ceramic (hereinafter referred to as the "sinter method") (see Nippon Ceramics Kyokai Gijutsu Ronbun-Shi, 96 [3], 292–298 (1988).

Since, however, the "sinter method" involves a technique wherein a mixture of alumina powder with iron powder is sintered by hot pressing to integrally form a member, the whole member comprises a ceramic when this method is applied to an actual member. Therefore, like the above-described first prior art method, this method is excellent in the wear resistance but is poor in the impact resistance and toughness, which makes it impossible to apply this method to pump members. Further, the production of a member entirely consisting of ceramic brings about an increase in the cost, which renders this method unsuitable for practical use.

Further, according to the "sinter method", the pressure should be distributed throughout the whole member by hot pressing, so that only a member having a flat or cylindrical shape or a simple shape similar thereto can be formed by this method.

SUMMARY OF THE INVENTION

An object of the present invention is to solve the above-described problems, i.e., to provide a member having an improved surface layer having a combination of excellent wear resistance with toughness even under severe abrasive conditions.

In order to attain the above-described object, the member having an improved surface layer according to the present invention has a mixed layer comprising ceramic particles and a metal in a predetermined region of the surface of a base body comprising a metallic material.

The above-described mixed layer comprises a nucleus composed of ceramic particles and, covering the outer periphery thereof, an intermediate formation composed of ceramic particles and a metal. In this case, it is preferred that the above-described base body, the ceramic particles, and a major metallic component of the above-described mixed layer be cast iron, SiC particles, and stainless steel, respectively.

The term "intermediate formation" used herein is intended to mean a layer wherein elements constituting the ceramic and elements constituting the metallic powder co-exist. For example, when the intermediate formation comprises SiC particles and a stainless steel powder, it is a stainless steel phase which is rich in at least Si and C.

It is preferred that the metal and base body of the mixed layer (intermediate formation) comprise different materials from each other. In particular, it is preferred that the metallic powder of the mixed layer form a ceramic particle constituting element and, at the same time, form an intermediate formation on the surface of the ceramic particles through dissolution in a molten metal which will be described later.

The process for making a member having an improved surface layer according to the present invention comprises molding ceramic particles with a binder into a predetermined shape, putting the resultant compact in a predetermined place along the internal wall of a mold, and pouring a molten metal thereinto. In the formation of the above-described molding, a metallic powder (e.g., iron powder) is incorporated. In this case, the above-described ceramic particles and metallic powder may be SiC particles and stainless steel powder, respectively.

It is preferred to heat the mold at a predetermined temperature before pouring a molten metal thereinto. Further, it is preferred to apply a pressure difference when the molten metal is poured.

BRIEF DESCRIPTION OF THE DRAWINGS

FIGS. 1 and 2 are each an explanatory cross-sectional view of a member having an improved surface layer according to the present invention;

FIG. 3 is an explanatory cross-sectional view of another example of a member having an improved surface layer according to the present invention;

FIG. 4 is a flow diagram illustrating the process of the present invention;

DESCRIPTION OF THE PREFERRED EMBODIMENTS

Figure 5:
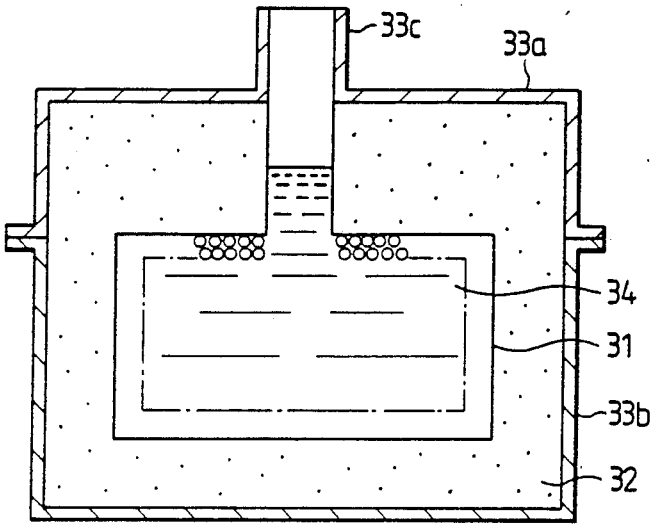
FIG. 5 is a diagram illustrating an example of the process of the present invention.

The member having an improved surface layer according to the present invention has a cross-sectional structure shown in, e.g., FIG. 1. The cross section of the member 10 comprises a base body 11 composed of a metallic material and constituting an internal portion and, provided on the surface thereof, a mixed layer 12 composed of ceramic particles and a metal. As shown in a schematic diagram of a microstructure shown in FIG. 2, the mixed layer 12 comprises a ceramic particle 13 and a reactive layer 14 composed of an intermediate formation formed through a reaction of the ceramic particle with the metal and an unreacted metal layer. A matrix metal layer 15 constituting the base body 11 is provided inside the mixed layer 12.

Because of the above-described structure, the hardness of the mixed layer 12 constituting the surface portion of the member 10 is governed by the hardness of the ceramic particle 13 and that of the intermediate formation in the reactive layer 14, so that the surface portion has sufficient wear resistance. Further, when the mixed layer 12 is formed so as to have a sufficient thickness (e.g., 2 to 6 mm or more), the surface portion can withstand severe abrasive conditions. Since, further, the toughness of the member as a whole is governed by the metallic material of the bas body 11, it is possible to impart sufficient toughness to the member.

When the intermediate formation provided around the ceramic particles of the mixed layer is formed so as to have a sufficient thickness, high wear resistance can be ensured because not only the hardness of the intermediate formation is high but also the force of bonding between the ceramic particles and the metallic layer is strong.

As opposed to a mixed layer comprising a combination of SiC particles with iron (e.g., cast iron or cast steel), when the mixed layer is formed from SiC particles and stainless steel, as shown in FIG. 3, the intermediate formation 14*a* has a sufficient thickness (e.g., about 50 to 500 μm) by virtue of a vigorous reaction and an unreacted metal layer 14*b* is reduced, which contributes to a further increase in the hardness. Since, further, the hardness of the intermediate formation and that of the unreacted SiC particle are approximately 500 to 600 and approximately 2600 to 3500 in terms of the Vickers hardness (Hv), respectively, wear hardly occurs even when hard particles, such as sediment, collide with the member. Further, when the mixed layer 12 comprises stainless steel, it is possible to impart corrosion resistance to only the surface portion.

On the other hand, in the process for making a member having an improved surface layer according to the present invention, a homogeneous mixture is first prepared by mixing ceramic particles with a small amount of a binder.

A space provided between the metal molds 21*a* and 21*b* (or wooden molds) shown in, e.g., FIG. 4 (*a*) according to a predetermined region or shape which should actually have wear resistance is filled with the mixture to prepare a molding 22 through ramming or the like. In this case, the width of the space is set to the thickness (e.g., 2 to 6 mm) of an intended wear-resistant layer (mixed layer 12).

As shown in FIG. 4 (*b*), the molding 22 thus formed is placed in a predetermined position of a mold cavity of molds 23*a*, 23*b*, and 23*c* for metal casting, and a molten metal 24 for matrix is poured into the remaining mold cavity portion.

This causes the molten metal 24 to infiltrate into gaps formed between the ceramic particles of the molding 22, and a given reaction occurs between the ceramic particles and the molten metal through heat of the molten metal. Consequently, the molten metal is gradually cooled to solidify while forming an intermediate formation around the ceramic particles 13.

After the metal is solidified, the molds 23*a*, 23*b*, and 23*c* are removed, thereby forming, as shown in FIG. 4 (*c*), a member 10 having, on the surface thereof, a mixed layer 12 comprising ceramic particles and a metal tightly bonded to each other. The binder used for the molding of the ceramic particles substantially disappears in the step of pouring. Specifically, an organic binder (such as PVA) disappears, while an inorganic binder, e.g., colloidal silica, leaves $SiO_2$ behind, though no problem occurs because the amount of the remaining $SiO_2$ is small (about 15% of the amount of the binder).

The member having an improved surface layer thus obtained comprises a wear-resistant mixed layer having a necessary and sufficient thickness and provided in only a necessary portion of the member, and has high toughness as a whole.

When metal powder (such as iron powder) is preliminary compounded with the molding 22 of ceramic particles, the metal powder is melted by the heat of the molten metal 24 to promote the infiltration of the molten metal 24 into the gaps formed between the ceramic particles, so that a mixed layer having a sufficient density can be prepared.

When the ceramic particles 13 and the metal powder are SiC particles and stainless powder, respectively, there occurs such a vigorous reaction therebetween that an intermediate formation 14*a* having sufficient thickness and size is formed as shown in FIG. 3. The presence of the intermediate formation 14*a* not only contributes to an increase in the hardness of the mixed layer as a whole but also strengthens the bond between the SiC particles and the unreacted metal layer 14*b*. The hardness of this intermediate formation 14*a* is 3 to 4 times higher than that of the matrix metal.

In the above-described step of pouring, the heating of the mold at a predetermined temperature contributes to promotion of a reaction for forming the mixed layer 12, and the application of a pressure difference for pouring through a member 25 shown in FIG. 4 (*b*) promotes the infiltration of the molten metal 24 into the molding 22, which contributes to an improvement in the adhesion between the particles and the metal.

According to the above-described conventional sinter method, scarcely any reaction of $Al_2O_3$ with iron occurs because iron is not in a molten state, so that no intermediate formation according to the present invention can be observed. Therefore, it can be said that the mixed layer prepared according to the present invention is superior to the sinter method in the mechanical properties such as hardness.

Examples of preferable ceramic particles include, besides the above-described SiC particles, those which have higher hardness than the matrix metal and can react with the molten metal or the mixed metal powder (such as iron or stainless steel) at a high temperature.

The binder should be selected by taking into consideration the melting point of the pouring metal. That is, any binder may be used as far as it does not lose its binding power at the melting point of the pouring metal. The binder is preferably a high-melting one such as colloidal silica. In some cases, ethyl silicate and water glass may also be used. Further, the binder is preferably one which exhibits its binding power even in a small amount thereof.

The mold may be one prepared by making use of any aggregate and binder as far as it permits the molten metal to be poured thereinto and can withstand the temperature employed for heating the molding enclosed in the mold cavity. Specific examples of suitable mold include inorganic molds such as $CO_2$ mold. An organic mold, such as furan resin mold, may also be used in the case of pouring of cast iron. The mold may not be always an integral mold.

In the case of controlled atmospheric heating, it is preferred that the wall of the mold have a slightly small thickness.

The mold is generally heated by controlled atmospheric heating. However, the mold can be rapidly heated by induction heating.

The pattern material for mold is preferably wax. Molten wax is poured into the cavity of a silicone rubber mold in which the above-described molding 22 comprising ceramic particles and a metal powder is embedded. After the wax is hardened, the silicone rubber mold is removed, thus giving an integral pattern of wax in which a molding 22 has been provided in a portion required to have wear resistance.

The molten metal (pouring metal) 24 may comprise any component as far as it is iron or its alloy. However, the molten metal is preferably one which reacts in a molten state with ceramic (SiC).

EXAMPLE 1

This Example demonstrates, with reference to FIG. 5, a process for making a member having an improved surface layer shown in FIG. 3 wherein ceramic particles, stainless steel, and cast iron are employed as SiC particles 13, metallic material for mixed layer 12, and metallic material for base body 11, respectively.

At the outset, SiC particles (100 mesh at maximum size) and stainless powder (100 mesh at maximum size) were prepared in a volume ratio of 1:1, and colloidal silica was added thereto and homogeneously mixed therewith. It is preferred that the SiC particles or stainless powder has a particle size distribution of 50 to 200 mesh. The mixing ratio is preferably 1:1 to 1:2.

The above-described mixture is molded with a mold having a predetermined shape into a molding 31 having a predetermined shape and a predetermined thickness of a wear-resistant layer necessary for the member.

As shown in FIG. 5, the molding 31 is embedded in a predetermined position within a cavity of an inorganic self-curing mold 32. Then, the mold 32 is set in metal flasks 33*a* and 33*b*. Hot air of 600° C. is blown through an opening 33*c* provided in the central portion of the upper metal flask 33*a* to heat the molding 31 at about 500° C. Thereafter, molten cast iron 34 of 1600° C. was poured through the opening 33*c*. The temperature of the molten metal is preferably 1400° to 1600° C.

Figure 6:
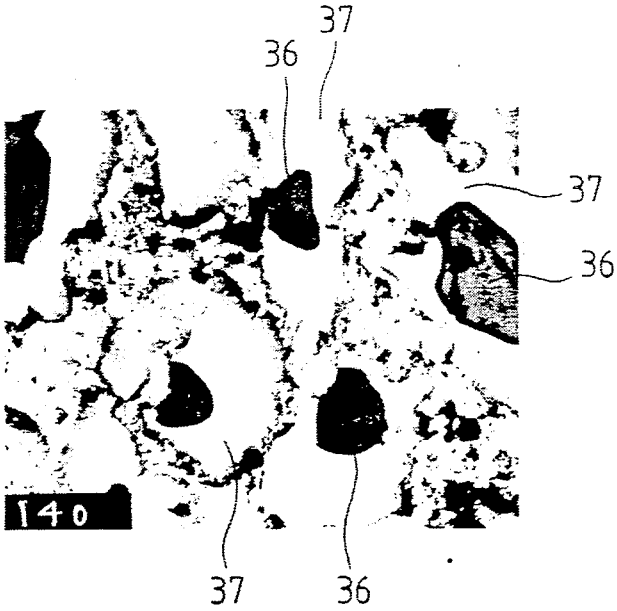
FIG. 6 is a metallographic photograph of a member having an improved surface layer produced in the example shown in FIG. 5.

After the molten metal 34 solidified, the mold 32 was removed. Thus, a member 10 having an improved surface layer was produced in a depth of about 5 mm from the surface of the casting. It has a mixed layer 12 of a structure shown in FIG. 3 comprising SiC particles and stainless steel. FIG. 6 is a photograph of a microstructure of the formed mixed layer 12. As is apparent from the drawing, the SiC particles 36 are reduced in their size as a result of a reaction with the stainless steel powder in a molten state, and intermediate formations 37 formed by the reaction of SiC with stainless steel exist around the reduced SiC particle. A metallic layer mainly composed of unreacted stainless steel and containing a poured metal exists around the intermediate formation 37.

The specimen of the present Example was subjected to measurement of hardness (Hv). As a result, it was found that the cast iron portion, intermediate formation, and SiC particle had hardnesses of 150, 500 to 600, and 2700 to 3000, respectively.

EXAMPLE 2

Figure 7:
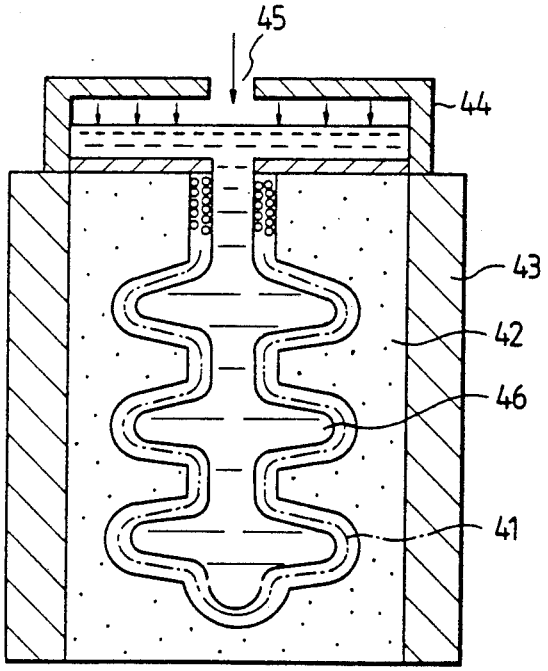
FIG. 7 is a diagram illustrating another example of the process of the present invention.

This Example demonstrates, with reference to FIG. 7, a process for making a member having an improved surface layer which comprises stainless steel as the base body 11 and, provided on the surface thereof, a mixed layer 12 composed of SiC particles and iron.

At the outset, 100 parts by weight of SiC particles having a size of 150 mesh are homogeneously mixed with 8 parts by weight of a binder (a mixed solution comprising an aqueous water glass solution having a specific gravity of 1.5 and 7% of an aqueous 10% PVA solution). The mixture was molded into a predetermined shape and dried to prepare a molding 41. The iron powder had a maximum size of 100 mesh and was used in an amount of 200 parts by weight. The molding 41 was formed to have a thickness of 4 mm.

The mold used was a multisplit iron powder mold 42 shown in FIG. 7. This mold 42 was a $CO_2$ mold composed of 100 parts by weight of 300-mesh iron powder and 6 parts of No.3 water glass.

A high-frequency coil 43 was provided outside the mold 42. The iron powder mold 42 was induction heated to about 600° C. with a high-frequency wave. The heat of the mold was conveyed to the molding 41 comprising SiC and iron powder, thereby raising the temperature of the molding to the same temperature as that of the mold.

Then, a metal flask 44 was provided on the mold 42. Molten cast steel 46 was poured through a pouring gate 45. Immediately after pouring, a pressurized air of 3 atm was applied to the surface of the molten metal, thereby causing the molten metal 46 to be brought into close contact with the molding 41 to form an integrated product. A series of steps leading to the heating of the mold 42 and the molten cast steel 46 were conducted in an inert atmosphere.

After solidification of the molten metal 46, shake-out was conducted to make a cast steel member having a wear-resistant layer provided on the surface thereof.

As described above, the member having an improved surface layer comprises, provided on the surface thereof, a mixed layer composed of ceramic particles and a metal and a base body composed of a metallic material provided within the mixed layer. In this structure, since the ceramic particles ensure sufficient wear resistance of the member, the member can withstand severe abrasive conditions for a long period of time. Further, the base body ensures sufficient toughness. Thus it is also possible to use the member of the present invention for parts such as the impeller of a pump used under severe conditions.

Further, when the member of the present invention comprises a mixed layer composed of ceramic particles and a metal and, surrounding the mixed layer, an intermediate formation formed by a reaction of the ceramic particles with the metal, the above-described effect becomes more significant by virtue of high hardness of the intermediate formation.

According to the process of the present invention, not only the above-described member having an improved surface layer can be obtained but also it is possible to easily impart wear resistance to a member having any shape by virtue of adoption of the pouring method. Further, the wear-resistant layer (mixed layer) can be formed in an intended portion in an intended thickness on the surface of the member. Therefore, it is possible to form a wear-resistant layer only in a portion required to have wear resistance and form the other portions with a metal having excellent toughness. In other words, the present invention can take wide variations according to need.

What is claimed is:

1. A process for making a member having an improved surface layer, which comprises mixing ceramic particles with metal powder, molding the mixture with a binder into a predetermined shape, placing the molded mixture in a predetermined position along an internal wall of a mold, and pouring a molten metal thereinto, so that heat from said molten metal melts said metal powder and an intermediate formation is produced by reaction of said ceramic particles with metal of said metal powder, thereby forming a mixed layer in a predetermined region of the surface of said member, said mixed layer being comprised of said ceramic particles, each of which is surrounded by said intermediate formation and an unreacted metal layer.

2. A process for making a member having an improved surface layer according to claim 1, wherein said ceramic particles are SiC particles, said metal powder is stainless steel powder and said molten metal is cast iron.

3. A process for making a member having an improved surface layer according to claim 1 or 2, wherein said mold is heated at a predetermined temperature before said molten metal is poured thereinto.

4. A process for making a member having an improved surface layer according to claim 1, wherein said molten metal is an iron-base metal and a pressure difference is provided in pouring said iron-base metal into said mold.

* * * * *